United States Patent [19]

Kahn

[11] Patent Number: 4,693,094

[45] Date of Patent: Sep. 15, 1987

[54] CIRCULAR KNITTING NEEDLE ASSEMBLY

[75] Inventor: Jan E. Kahn, Oak Lawn, Ill.

[73] Assignee: Newell Co., Freeport, Ill.

[21] Appl. No.: 863,776

[22] Filed: May 16, 1986

[51] Int. Cl.[4] ..... D04B 35/02

[52] U.S. Cl. ..... 66/117

[58] Field of Search ..... 66/117, 118, 116

[56] References Cited

U.S. PATENT DOCUMENTS

| | | | |
|---|---|---|---|
| 1,999,691 | 4/1935 | Graham | 66/117 |
| 2,102,600 | 12/1937 | Miller | 66/117 |
| 2,183,791 | 12/1939 | Dunn | 66/117 |
| 2,208,124 | 7/1940 | Dunn | 66/117 |
| 2,633,720 | 4/1953 | Robbins | 66/117 |
| 2,695,506 | 11/1954 | Kohlmann | 66/117 |
| 3,280,595 | 10/1966 | Linstead | 66/117 |
| 4,007,610 | 2/1977 | Linstead | 66/117 |
| 4,341,094 | 7/1982 | Heide | 66/117 |
| 4,494,387 | 1/1985 | Phipps et al. | 66/117 |
| 4,533,410 | 11/1985 | Okada | 66/117 |

FOREIGN PATENT DOCUMENTS

| | | | |
|---|---|---|---|
| 969477 | 6/1958 | Fed. Rep. of Germany | 66/117 |
| 1220962 | 7/1966 | Fed. Rep. of Germany | 66/117 |
| 98588 | 7/1961 | Norway | 66/117 |
| 2036812 | 7/1980 | United Kingdom | 66/117 |

*Primary Examiner*—Ronald Feldbaum

*Attorney, Agent, or Firm*—James G. Staples

[57] ABSTRACT

A circular needle assembly having a scored connecting means joining the needle and cable together.

1 Claim, 3 Drawing Figures

CIRCULAR KNITTING NEEDLE ASSEMBLY

The invention relates to the art of knitting and more particularly to a circular knitting needle assembly. More specifically, the invention relates to circular knitting pin connections in a circular knitting needle assembly.

BACKGROUND OF THE INVENTION

Circular knitting needles are well-known in the art. Generally they comprise a pair of needles whose back ends are joined together by a flexible cable. They are especially adapted for and useful in the knitting of tubular products or garments, such as the sleeves or the body of a sweater. In the past difficulties have been encountered in some circular knitting needle assemblies in the knitting performance at the working ends of the needles, and in the storage section of the assemblies. The problem of splitting yarn has been encountered for example at the working ends of the needles, especially when the needle tips are formed with a constant taper from the shank portion of the needle and also when the nose extremity is rounded, or bull nosed, in configuration. The problem of the yarn catching and not moving smoothly along the assembly has been encountered in prior circular knitting needle assemblies at the junction area between the needle and the flexible connecting cable. In some instances a "growth" has developed around the hole in either the needle or the cable which receives the conventional pin which joins the needle to the cable, with the result that the parts work loose and eventually separate before the useful life of the assembly is reached. In addition the wobble of the cable with respect to the connection eventually causes a portion of the edge of the end of the cable to project beyond the abutting end of the needle with the result of an obstruction to the movement of the yarn. This feature is highly irritating to the user since it disturbs the knitting rhythm and can even snag the yarn as it catches on the projecting edges of the joint when the user moves the yarn back and forth, as required, over the joint.

BRIEF SUMMARY OF THE INVENTION

The circular knitting needle assembly of this invention includes two knitting needles which are connected to one another by a flexible cable so as to enable tubular products, such as the sleeves and body of a sweater, to be knitted. The cable includes a flared portion at each end which exactly mates with a reduced diameter end of each of the needles. A scored insert is secured in aligned sockets in the needles and the cable to join the needles to the cable. Accordingly, a primary object of this invention is to provide a circular knitting needle assembly in which a pair of knitting needles are joined to a cable by a connection which results in a smooth, uninterrupted contour at the junction between the needles and the cable.

Another object of this invention is to provide a circular knitting needle assembly having a pair of needles joined to a flexible cable by connection means which results in a smooth, uninterrupted contour at the junction between the needles and the cable in which the connection means includes an insert which is received in axially aligned sockets in the back end of a needle and an associated end of the cable when the back end of the needle is in abutting engagement with the end of the cable.

A further object of the invention is to provide a assembly as described above in which the formation of a "growth" of the hole in which the insert is received is avoided.

Other objects and advantages of the invention not specifically mentioned above will become apparent from the following description of the invention.

BRIEF DESCRIPTION OF THE DRAWING

The invention is illustrated more or less diagrammatically in the accompanying drawing wherein.

DETAILED DESCRIPTION

Figure 1:
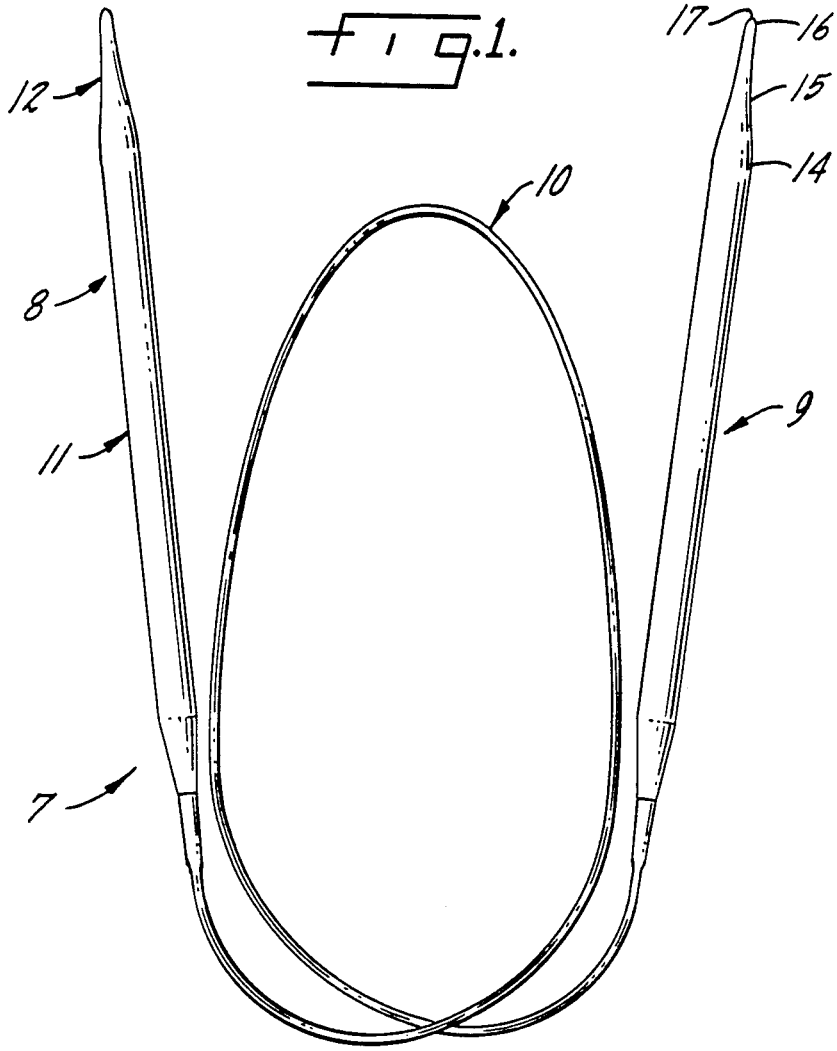
FIG. 1 is a perspective view of the circular knitting needle assembly of this invention in an assembled condition.

Reference is made to the accompanying drawing wherein like reference numerals will be used to refer to like parts from Figure to Figure of the drawing.

The circular knitting needle assembly of this invention is indicated generally at 7 in FIG. 1. The assembly includes a pair of knitting needles, indicated generally at 8 and 9, and a cable indicated generally at 10. Each of the needles 8 and 9 is identical and hence a description of one will suffice for both.

Each needle includes an elongated shank 11 having a substantially uniform nominal diameter from the forward end to the rearward end of the needle. A tip portion is indicated generally at 12, and a back portion at 13.

Referring specifically to the tip portion 12, it will be noted that said tip portion includes a blended shoulder portion 14, a double run concave 15, and a lancet point 16. The lancet point terminates in a distinct, but not sharp, point 17. This construction minimizes yarn splitting and dropping of stiches.

The needle is preferably made of a relatively strong, slightly flexible material which has a warm feeling and pleasant comfort similar to whale bone.

Figure 3:
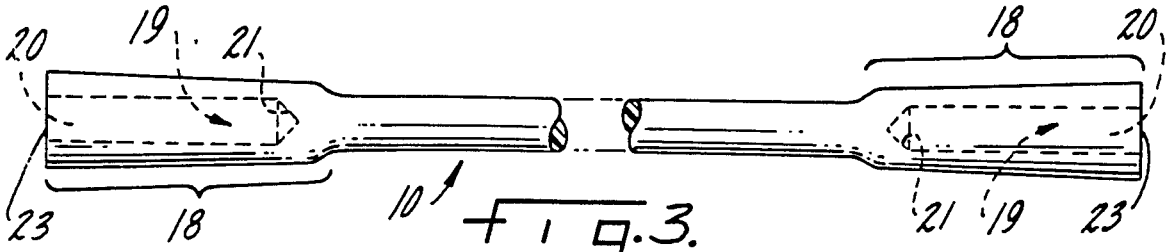
FIG. 3 is a side view to the same scale as FIG. 2 of the cable with portions broken away for clarity.

The cable 10, which is illustrated best in FIG. 3, is flexible, which feature is clearly illustrated in FIG. 1, and terminates at each end in a flared end portion 18. Since each end portion 18 is identical, a description of one will suffice for both. In this instance the flared end portion 18 has a gradually and uniformly increasing diameter in an outward direction. A socket, indicated generally at 19, is formed in each end of the flared end portion 18. The socket 19, in this instance, is composed of a bore 20 of uniform diameter which terminates, at its inward end, in an end wall 21. The end surface 23 of each flared end portion is planar, with the plane of the end surface 23 being disposed generally perpendicularly to the axis of the bore 22.

Figure 2:
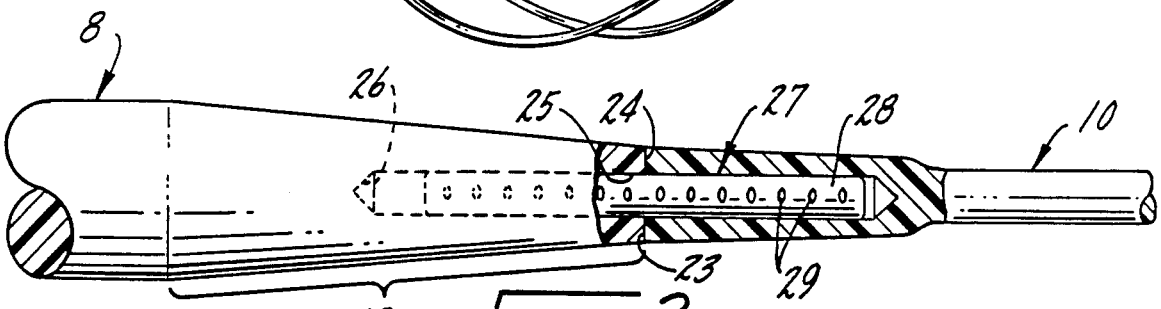
FIG. 2 is a view, to an enlarged scale, of the junction area between the back end of one of the needles and an associated end of the cable with portions broken away for clarity.

As best seen in FIG. 2, the back end portion 13 of each needle has a gradually and, in this instance, a uniformly decreasing diameter which terminates at end surface 24. Since the diameter of end surface 24 equals the diameter of end surface 23, the contour of the external surface will be smooth and uninterrupted at the junction between the back end portion 13 of the needle and the flared end portion 18 of the cable. Further, when assembled as illustrated in FIG. 2, the needle will be in abutting relationship to the cable ends.

A socket 25 is formed in the back end portion of needle 8, which socket terminates in an end wall 26. The socket 25 is preferably of a length somewhat greater than the depth to which a connection means, to be described hereafter, extends when in assembled condition so as to partially counteract air pressure build-up in the socket when the connection means is inserted.

Connection means for joining each needle to an associated end of the cable is indicated generally at 27. In this instance the connection means 27 comprises a metal insert 28 having a diameter substantially equal to the diameter of the bores 25 and 19 in the needle and cable respectively. Preferably the metal insert is located in the aligned bores 25 and 19 with a tight friction fit. In addition to the friction fit, however, it has proven advantageous to utilize scores 29 which provide additional gripping and, indeed, a mechanical locking force between the walls of the bore and the metal insert. This arrangement will ensure that no separation of the needles from the cable will occur during the useful life of the assembly The use and operation of the invention is as follows.

In construction, care is taken to ensure the the taper of the back end portion 13 of the needle terminates in an end surface 24 of a diameter which is equal to the diameter of end surface 23 on the flared end portion 18 of cable 10 so that, when assembled, the joint or junction between the needle and cable will be smooth and uninterrupted, thereby eliminating any discontinuity in this area. Further, the equal diameter bores 25 and 19 in the needle and cable respectively are axially aligned and, thus, when the insert 28 is installed, the joint formed by end surfaces 23 and 24 is smooth and uninterrupted.

With the above described construction, no undesirable discontinuity is formed in the joint area which can snag and split yarn, or which momentarily obstructs movement of yarn across the joint, thus interrupting the knitting rhythm of the user.

Further, the use of the elongated insert 28 and, preferably, the scores 29, will prevent any "growth" around the bore 25 of the needle, a problem which has occurred in prior constructions.

Although a preferred embodiment of the invention has been illustrated and described, it will at once be apparent to those skilled in the art that the invention includes advantages and features over and beyond the specific illustrated construction. Accordingly it is intended that the scope of the invention be limited solely by the scope of the hereinafter appended claims, and not by the foregoing specification, when interpreted in light of the relevant prior art.

I claim:

1. In a circular knitting assembly, a knitting needle, said knitting needle having a rear end adapted to make abutting engagement with a cable, a cable, said cable having an end adapted to make abutting contact with the rear end of a knitting needle, the rear end of the needle having a smoothly decreasing diameter in the direction of the cable, the end of the cable having a smoothly increasing diameter in the direction of the needle, the diameter of the needle and cable being identical at the junction where the respective ends abut, whereby the junction between each needle and its associated cable end is smooth and uninterrupted throughoutthe useful life of the circular knitting assembly, connection means for ensuing that no growth appears at the junction between the abutting ends, said connection means including a socket having a constant diameter through its operative length formed in the end of the needle, a socket having the same constant diameter throughout its operative length formed in the end of the cable, said sockets being axially aligned when the needle and cable are in their final, abutting relationship, a constant diameter insert received in the aligned sockets in close fitting engagement with the constant diameter sockets in the needle and cable, and score means on the insert in the area of engagement between the insert and the needle face, and between the insert and the cable face said cable and needle sockets, where they receive the insert, having material integral therewith filling the score means whereby separation of the cable from the socket during the useful of the knitting assembly is precluded.

* * * * *